United States Patent [19]

Wimmer

[11] Patent Number: 5,054,128

[45] Date of Patent: Oct. 8, 1991

[54] ORNAMENT FOR SUSPENDERS

[76] Inventor: Merri J. Wimmer, 509 52nd St., West Des Moines, Iowa 50265

[21] Appl. No.: 554,836

[22] Filed: Jul. 20, 1990

[51] Int. Cl.[5] ..... A41F 3/00

[52] U.S. Cl. ..... 2/300; 2/340; 2/246

[58] Field of Search ..... 2/230, 300, 340, 244, 2/245, 246, 336, 312; 132/273, 275

[56] References Cited

U.S. PATENT DOCUMENTS

| | | | |
|---|---|---|---|
| 5,478 | 1/1872 | West | D 2/640 |
| 7,243 | 3/1874 | Flagg | D 2/640 |
| 21,791 | 8/1892 | Harris | D 2/640 |
| 35,999 | 8/1902 | Wertheimer | D 102/818 B |
| 141,622 | 6/1945 | Steigerwald | D 102/819 |
| 726,830 | 4/1903 | Wheelock | 2/300 |
| 1,262,093 | 4/1918 | Preston | 132/275 |
| 1,353,930 | 9/1920 | Merkel et al. . | |
| 1,370,066 | 3/1921 | Stern . | |
| 1,528,882 | 3/1925 | Kennerly | 2/337 |
| 1,600,612 | 9/1926 | Witkowska | 2/300 |
| 1,955,647 | 4/1934 | Mix | 2/300 |
| 1,980,075 | 11/1934 | Mix | 2/300 |
| 2,015,113 | 9/1935 | Johnson | 2/300 |
| 2,080,058 | 5/1937 | Parry | 241/1 |
| 2,105,436 | 1/1938 | Fiatto | 132/275 |
| 2,448,839 | 9/1948 | Steigerwald | 2/340 |
| 2,467,380 | 4/1949 | Hansen | 2/300 |
| 2,488,954 | 11/1949 | Winters | 132/275 |
| 3,099,271 | 7/1963 | Dubelier | 132/273 |
| 3,842,849 | 10/1974 | Goodman | 132/273 |
| 4,038,724 | 8/1977 | Parizek | 2/207 |
| 4,597,198 | 7/1986 | Schweitzer | 2/245 |
| 4,972,859 | 11/1990 | Noviello, Jr. et al. | 132/273 |

FOREIGN PATENT DOCUMENTS

| | | | |
|---|---|---|---|
| 919556 | 9/1945 | France | 2/300 |
| 10063 | 9/1898 | Sweden | 2/300 |
| 42092 | 2/1908 | Switzerland | 2/300 |
| 247497 | 2/1926 | United Kingdom | 2/300 |

*Primary Examiner*—Werner H. Schroeder
*Assistant Examiner*—Amy Brooke Vanatta
*Attorney, Agent, or Firm*—Armstrong, Nikaido, Marmelstein, Kubovcik & Murray

[57] ABSTRACT

A suspender set comprising at least one strap having two distal ends, one of the ends having a fastener adapted for securing the strap to an article of clothing, and having an ornamental device secured to the fastener. The ornamental device comprises a member having a major surface containing an ornamental design and a second surface opposed to the major surface having a connector element extending from the second surface and releasably secured to the fastener.

8 Claims, 2 Drawing Sheets

ORNAMENT FOR SUSPENDERS

BACKGROUND OF THE INVENTION

The present invention relates generally to ornaments for suspenders, and more particularly, to ornaments for suspenders such as suspender ends which tend to improve the overall appearance of the suspenders and which can be attached and removed from the suspenders in a relatively easy manner.

While the ornamental device of the present invention will be primarily discussed hereinafter with reference to its use in conjunction with a set of suspenders, it should be recognized that its use and application are not thereby so limited as the device may find use in other applications as well.

Suspenders have long been known for the purpose of supporting articles of clothing such as skirts, pants and trousers for both men and women. In recent years, the popularity of suspenders has increased greatly, primarily since the use of suspenders provides a distinctly different and attractive appearance as opposed to a belt or the like and tends to promote a somewhat different image for the person wearing the suspenders. While the basic construction for a set of suspenders has remained fairly constant over the last century or so, that is, the suspenders normally comprise a pair of straps which extend from the front waistband of the article of clothing with one strap extending over each of the shoulders of the wearer, cross each other in the back and then terminate at the back of the waistband with a fastener at each distal end of the straps, various attempts have been made over the years to make suspenders more stylish and distinctive. For example, the material forming the straps has been made in various colors and even combinations of colors such a parallel stripes of contrasting colors. Other attempts to provide the suspenders with a more stylish appearance have included providing the fasteners with an ornamental design such as that disclosed in U.S. Pat. No. Des. 7,243 to Flagg. It is also known from U.S. Pat. No. Des. 5,478 to West and U.S. Pat. No. Des. 21,791 to Harris to have a design surface on a buckle supporting the suspender ends. More recently, suspenders have been marketed which have an embossed design surface on the material which is used to join the straps at the point at which they cross in the back of the wearer.

While all these variations in the appearance of the suspenders do have the effect of providing a somewhat different appearance for the suspender set, these design variations are incorporated into the suspender as purchased. Thus it is not generally possible for the ultimate user of such suspender sets to conveniently alter the appearance of the sets to meet his or her changing fashion needs. In this regard, for example, it is not possible to change the color of a suspender or the ornamental appearance of a fastener. It would be however advantageous to provide means for the consumer to alter or change the appearance of a suspender set in an simple and economical manner.

SUMMARY OF THE INVENTION

It is therefore a feature of the present invention to provide an ornamental device adapted to be attached to a suspender set so as to alter the appearance of the set to, for example, coordinate the set with an article of clothing.

It is another feature of the invention to provide an ornamental device for suspender sets which can be easily secured to the suspender set yet allows the device to be removed from the set without undue inconvenience.

It is another feature of the present invention to provide a construction for an ornamental device for suspender sets which is adaptable to provide many different ornamental appearances for the set by the use of a plurality of devices each having a different design and overall appearance.

It is also a feature of the invention to provide an ornamental device for suspender sets which can be easily and simply constructed from relatively inexpensive materials.

Briefly, in its broader aspects, the present invention comprehends a suspender set comprising at least one strap having two distal ends, one of the ends having a fastener adapted for securing the strap to an article of clothing, and an ornamental device secured to the suspender set, the ornamental device comprising a member having a major surface containing an ornamental design and a second surface opposed to the major surface having a connector element extending from the second surface and releasably secured to the suspender set.

The present invention further comprehends an ornamental device adapted to be secured to a suspender set, the ornamental device comprising a member having a major surface containing an ornamental design and a second surface opposed to the major surface having a connector element extending from the second surface and adapted to be releasably secured to the suspender set.

Further features, objects and advantages of the present invention will become more fully apparent from a detailed consideration of the arrangement and construction of the constituent parts as set forth in the following description taken together with the accompanying drawings.

DETAILED DESCRIPTION OF THE PREFERRED EMBODIMENTS

Figure 1:
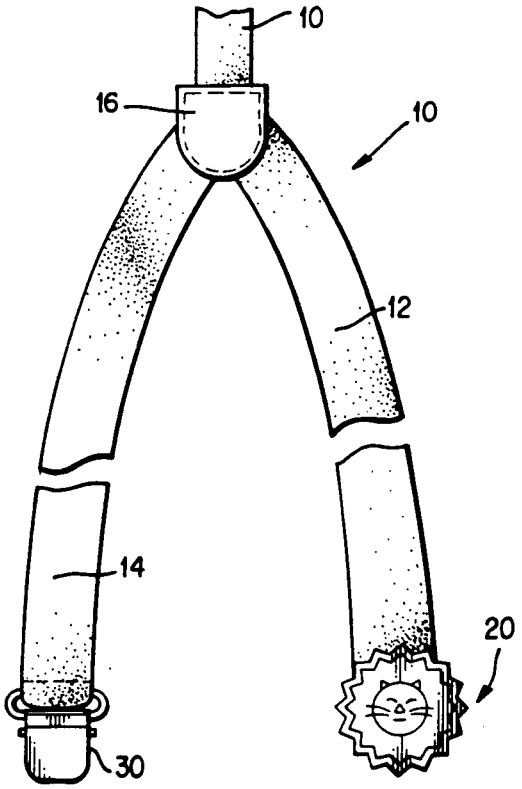
FIG. 1 is a plan view of one embodiment of a suspender set having an ornamental device according to the present invention, the suspender set being shown in its open or extended position.
Figure 2:
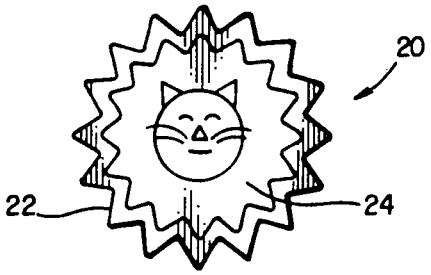
FIG. 2 is a plan view of the front of the ornamental device of FIG. 1 on a larger scale.

Referring first to FIGS. 1 and 2, shown is suspender set 10 with a device in accordance with the present invention, the suspender set being shown in its open or extended position. It should be understood that the particular construction for suspender set 10 may vary considerably for the purposes of the present invention. In the embodiment shown, suspender set 10 comprises elongated straps 12 and 14 joined to each other at one end by means such as reinforcing element 16 secured to the straps by stitching and the like. Reinforcing element 16 also secures rear strap 18 to straps 12 and 14. Straps 12 and 14 are adapted to extend from the front portion of a waistband of an article of clothing (not shown) over the shoulders of the wearer with the reinforcing element being located in the middle of the back area with rear strap 18 secured to the back portion of the waistband.

The distal end of each strap 12, 14 and 18 remote from reinforcing element 16 is provided with a fastener 30 in the form of a clasp, the fastener shown in the lower portion of FIG. 1 being adapted to secure the suspender set to the front portion of an article of clothing such as onto the waistband of a skirt or a pair of trousers. As is also conventional, upper fastener 30 shown in FIG. 1 is adapted to be secured to the rear of an article of clothing such as the back portion of the waistband. In accordance with the present invention, ornamental device 20 is secured to the fastener on the distal end of strap 12. Although only one ornamental device is shown in FIG. 1 for clarity, it is preferred that both straps 12 and 14 would include an ornamental device and perhaps eve strap 18.

It should be recognized that the particlar type of suspender set shown in FIG. 1 is just one of many types of known constructions for suspender sets. For example, the set could have straps which cross at the reinforcing element and extend to the back portion of the waistband. Alternatively, the straps could extend from front to back without crossing and be joined by a transverse strap or element. The subject invention is appropriately used in conjunction with other types of constructions for suspender sets equally well as the one illustrated.

As is better shown in FIG. 2, ornamental device 20 of this embodiment comprises a generally circular disc or plate member 22 having a plurality of spikes or points about the periphery of the disc member for ornamental purposes. Disk member 22 is preferably unitary and is of rigid or semirigid material such as metal, ceramic, polymeric material, clay, elastomeric material and the like. A presently preferred material for disc member 22 is a clay-like ceramic for ease of fabrication, cost and appearance. On generally planar major planar surface 24 of disc member 22 is ornamental design in the form of fanciful cat-like face in this embodiment. The ornamental design can be applied on major surface 24 of ornamental device 20 in a variety of manners such as, for example, coloring material such as paints, or by transfers, photographs and the like. For example, when disc member 22 is made of clay-like ceramic material, the design can be incorporated onto the disc member by the use of various glazes arranged in patterns before the ceramic material is fired. In addition, surface treatment of major surface 24 by embossing, etching, and the like may be suitable for providing a relief type ornamental design, particularly for metals and polymeric materials and the like. Also the design may be formed simultaneously with member 22 such as by molding, casting and the like followed by coloration of selected portions of major surface 24 if desired.

Figure 3:
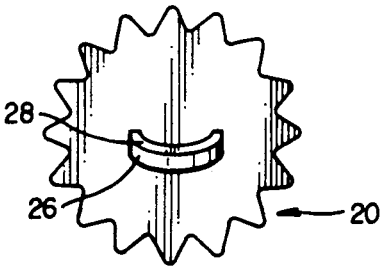
FIG. 3 is a plan view of the rear of the ornamental device of FIG. 2.

FIG. 3 is a rear plan view of ornamental device 22 of FIG. 2. Ornamental device 22 is provided with a releasable connector 26 which is secured to planar surface 28 opposed to and parallel with major surface 24. In the embodiment shown, releasable connector 26 comprises a small loop of elastic material, the ends of which are embedded in disc member 22 to securely retain the loop on ornamental device 20. Loop connector 36 is sized such that, by stretching the loop slightly, the connector can be slipped over a portion of suspender set 10 to thereby releasably secure the ornamental device to the set. Other suitable forms of a connector element such as a clip and the like may be used instead of the loop element shown.

Figure 4:
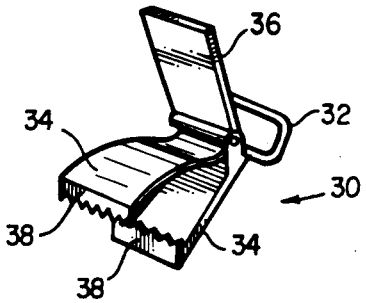
FIG. 4 is an enlarged perspective view of a fastener of FIG. 1 with the fastener being in its open position suitable for insertion about the waistband of an article of clothing.

FIG. 4 is a detailed perspective view of clasp 30 illustrated in FIG. 1. Clasp 30 is typical of the types of fasteners conventionally used on suspender sets to secure the set to the waistband of an article of clothing. Clasp 30, which forms no part of the subject invention per se, is of the clamping jaw type and includes loop element 32 adapted to retain a loop in one strap of suspender set 10, a pair of jaws 34 hinged together at one end and secured to the loop element, and lever 36 also hinged along the axis about which the jaws are hinged. Jaws 34 have opposing teeth 38 on the end of the jaws opposed from the hinged portion. In the open position as shown, jaws 34 are adapted to extend on either side of the waistband of an article of clothing and then when lever 36 is pivoted toward the jaws, the teeth of the jaws are releasably clamped about the waistband. Rotation of the lever in the opposite direction releases jaws 34 and clasp 30 can be removed from the waistband.

Figure 5:
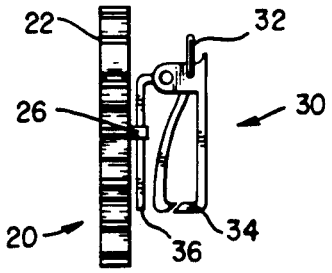
FIG. 5 is a detailed side view of of the ornamental device of FIGS. 2 and 3 secured to the clasp portion of the fastener shown in FIG. 3.

Turning now to FIG. 5, shown is a side view of ornamental device 20 of FIG. 2 secured to lever 36 of clasp 30 as shown in FIG. 3. Loop connector 26 has been slipped over lever 36 of clasp 30 to thereby secure the ornamental device to the clasp. Once suspender set 10 is worn, major surface 24 of ornamental device 20 will be visible and the clasp at least partially obscured by the ornamental device. 0f course, the device can be easily removed from clasp 30 simply by slipping loop connector 26 from the lever. While device 20 is shown affixed to clasp 30, it is contemplated that the device could be secured to other portions of the suspender set such as the straps.

As is apparent, the subject invention can be used in conjunction with other types of suspender fasteners than the one described above. For example, the fastener can have the construction where a so-called suspender end is utilized, generally in the form of an elongated leather type strap having a slit therein which is adapted to be secured about a button carried by the article of clothing. In this regard, the connector element could extend about the strap or could be in a T-shape with the upper portion adapted to be inserted within the slit. In addition, the device could be secured to other types of metallic clasp type fasteners.

As was previously mentioned, the ornamental device of the invention can take any desired shape, size or configuration and can have imprinted or otherwise affixed thereto a wide variety of designs, colors, characters and the like as will be apparent to those of oridinary skill in the art to which the present invention pertains.

Figure 6:
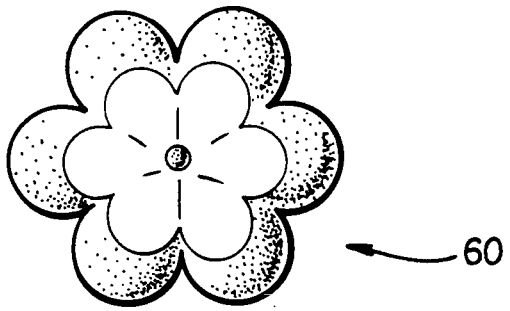
FIG. 6 is a plan of another illustrative embodiment of an ornamental device according to the present invention.
Figure 7:
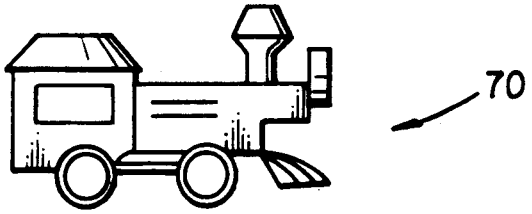
FIG. 7 is a plan of a further illustrative embodiment of an ornamental device according to the present invention.
Figure 8:
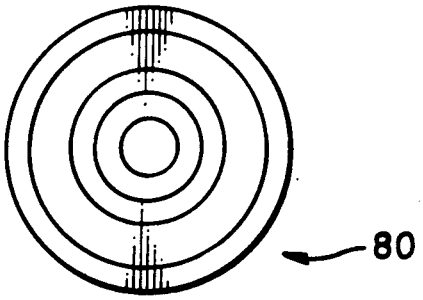
FIG. 8 is a plan of yet another embodiment of an ornamental device according to the present invention.

The embodiments of the ornamental device shown in FIG. 6 through 8 provide several illustrative examples. In FIG. 6, ornamental device 60 is in the shape of suggesting a flower which may be of contrasting colors. In FIG. 7, ornamental device 70 is in the overall shape and appearance of a steam locomotive. In FIG. 8, ornamental device 80 is circular having concentric circles and again may be of contrasting colors.

Suitable methods for making the ornamental device can vary considerably. Where connector means is in the form of an elastic type loop, the elastic material may be secured to the disc member by embedding the ends as was previouly mentioned, or can be affixed to the surface of the device by adhesives, fasteners such as rivets and the like. Disc member can be made by molding, cutting from blanks, ceramic forming techniques, hardening from liquids and the like.

From the foregoing, it is readily apparent that the ornamental device in accordance with the present invention provides a distinct advantage in providing a device which is particularly adapted to alter and improve the appearance of a suspender set. The ornamental device allows the user to easily modify the appearance of a suspender set to suit his changing fashion needs and requirements and to better coordinate the appearance of the suspender set with the clothing being worn. The device is suitable for use by both men and women and also provides a distinctive apparel assessory for children as well.

While there has been shown and described what is considered to be preferred embodiments of the present invention, it will be apparent to those skilled in the art to which the invention pertains that various changes and modifications may be made therein without departing from the invention as defined in the appended claims.

It is claimed:

1. A suspender set comprising at least one strap having two distal ends, one of the ends having a fastener adapted for securing the strap to an article of clothing, and an ornamental device secured to the fastener, the ornamental device comprising a member of rigid material and having a major surface containing an ornamental design and a second surface opposed to the major surface having a connector element secured to and extending from the second surface and releasably secured to a portion of the fastener of the suspender set, the connector element being a loop of continuous elastic material.

2. A suspender set in accordance with claim 1 wherein the set includes two straps each having a fastener.

3. A suspender set in accordance with claim 1 wherein the major surface of the ornamental device is generally planar.

4. A suspender set in accordance with claim 3 wherein the surface opposed to the major surface is planar and parallel with the major surface.

5. A suspender set in accordance with claim 4 wherein the ends of the loop of the connector element are secured to the surface opposed to the major surface.

6. A suspender set in accordance with claim 5 wherein the ends of the loop of the connector element are embedded in the member.

7. A suspender set comprising at least one strap having two distal ends, one of the ends having a fastener adapted for securing the strap to an article of clothing, the fastener in the form of a clasp comprising a pair of clamping jaws connected together at a hinge and a lever means for actuating said jaws, and an ornamental device secured to the fastener, the ornamental device comprising a member of rigid material and having a major surface containing an ornamental design and a second surface opposed to the major surface having a connector element secured to and extending from the second surface and releasably secured to a portion of the fastener of the suspender set, the connector element comprising a loop of continuous elastic material and the loop being around the lever means.

8. A suspender set in accordance with claim 7 wherein the lever means of the fastener is connected to the hinge.

* * * * *